US005298920A

United States Patent [19]

Shindo

[11] Patent Number: 5,298,920

[45] Date of Patent: Mar. 29, 1994

[54] DISPLAY DEVICE

[75] Inventor: Jiro Shindo, Mobara, Japan

[73] Assignee: Futaba Denshi Kogyo Kabushiki Kaisha, Mobara, Japan

[21] Appl. No.: 24,835

[22] Filed: Mar. 1, 1993

Related U.S. Application Data

[63] Continuation of Ser. No. 599,993, Oct. 19, 1990, abandoned.

[30] Foreign Application Priority Data

Oct. 20, 1989 [JP] Japan ..... 1-271745

[51] Int. Cl.[5] ..... G09G 3/00

[52] U.S. Cl. ..... 345/213; 345/75

[58] Field of Search ..... 340/811, 781, 771, 749, 340/750, 805, 784, 814, 799, 723, 731

[56] References Cited

U.S. PATENT DOCUMENTS

| | | | |
|---|---|---|---|
| 3,676,850 | 7/1972 | Goldman et al. | 340/724 |
| 4,626,837 | 12/1986 | Priestly | 340/749 |
| 4,662,718 | 5/1987 | Masubuchi | 340/814 |
| 4,688,030 | 8/1987 | Uemura et al. | 340/811 |
| 4,777,483 | 10/1988 | Fowler | 340/706 |

*Primary Examiner*—Ulysses Weldon
*Assistant Examiner*—Xiao M. Wu
*Attorney, Agent, or Firm*—Oblon, Spivak, McClelland, Maier & Neustadt

[57] ABSTRACT

A display device capable of carrying out positionally proper display. The display device is so constructed that drive data are stored in an address of a storage section corresponding to a counting signal of each of counters to set an initial value of the counter at a preset section. Thus, even when horizontal and vertical synchronous signals, clock signal and display signal are different in timing, the preset value of each counter may be varied to adjust deviation of a display section, resulting in exhibiting adequate display.

4 Claims, 3 Drawing Sheets

DISPLAY DEVICE

This application is a continuation of application Ser. No. 07/599,993, filed on Oct. 19, 1990, now abandoned.

BACKGROUND OF THE INVENTION

This invention relates to a display device, and more particularly to a display device such as a fluorescent display device or the like which is adapted to display characters, figures or the like.

A fluorescent display device which is one example of a conventional display device is generally constructed as shown in FIG. 3.

A fluorescent display tube (VFD) 309 which constitutes a display section of the fluorescent display device includes a plurality of control electrodes and anodes arranged so as to intersect each other, which cooperate together to form a matrix-like image plane for display. The control electrodes and anodes are adapted to be driven by a control electrode drive circuit 305 and an anode drive circuit 308, respectively, resulting in any desired characters and/or figures being displayed on the image plane.

A counter 301 is arranged so as to count a reverse signal $\overline{\text{HSYNC}}$ of a horizontal synchronous signal in response to the leading of a reverse signal $\overline{\text{VSYNC}}$ of a vertical synchronous signal to output a counting signal corresponding to a value counted by the counter. Data are written in addresses of a ROM 303 and data in the address to which the counting signal is input from the counter 301 are supplied to the control electrode drive circuit 305. For example, supposing that an output data at one of output terminals of the ROM 303 is 1010, a repetitive signal of high and low levels is obtained. Output signals of the ROM 303 include a grid clock signal, a clock effective signal for determining time at which the clock is handled to be effective and a grid clear signal for determining time at which a display section drive signal is output from the control electrode drive circuit 305. A drive signal is formed in the control electrode drive circuit 305 depending upon the grid clock signal from the ROM 303 and supplied to the VFD 309 in response to the clear signal from the ROM 303.

The counter 303 starts counting of the clock signal in response to the leading of the $\overline{\text{HSYNC}}$. A ROM 304 outputs data for a corresponding address in response to the counting signal from the counter 302. More specifically, a serial/parallel (S/P) conversion circuit 306 has supplied thereto an anode clock signal and a latch circuit 307 has supplied thereto a latch signal, and an anode clear signal for outputting a drive signal to an anode corresponding to a signal latched to the latch signal 307 is supplied to the anode drive circuit 308.

The S/P conversion circuit 306 takes in a display signal Vs in synchronism with the anode clock signal to store therein data corresponding in number to the anodes and then supplies the signal to the latch circuit 307 in the form of a parallel signal. The latch circuit 307 latches the so-supplied parallel signal in synchronism with the latch signal, resulting in the latched parallel signal being output from the anode drive circuit 308 to the VFD 309 in the form of a drive signal of a predetermined voltage in response to the anode clear signal.

In the VFD 309, the respective two control electrodes adjacent to each other are scanned in turn while being shifted one by one and synchronously the drive signal is supplied to the anodes, resulting in desired display being exhibited corresponding to the display signal.

When the above-described display device is used for a personal computer or the like, it is often experienced that the clock signal, $\overline{\text{VSYNC}}$, $\overline{\text{HSYNC}}$ and display signal are different in timing from each other depending upon the type of the personal computer. In the conventional display device, a display position is fixed, so that the difference in timing between the signals causes problems such as a failure in display at the central position on the image plane, a display defect and the like. In order to carry out display at a suitable position on an image plane, it is conventionally required to replace each of the ROMs 303 and 304 with another ROM.

SUMMARY OF THE INVENTION

The present invention has been made in view of the foregoing disadvantages of the prior art.

Accordingly, it is an object of the present invention to provide a display device which is capable of carrying out display at a proper position on an image plane.

In accordance with the present invention, there is provided a display device comprising a first counter for counting a horizontal synchronous signal in response to a vertical synchronous signal to output a first counting signal, a first storage section for outputting a signal stored in an address corresponding to the first counting signal, a second counter for counting a clock signal in response to the horizontal synchronous signal to output a second counting signal, a second storage section for outputting a signal stored in an address corresponding to the second counting signal, a display section, a drive section for driving the display section in order to provide a display corresponding to the display signal in response to the signals from the first and second storage section, and preset sections for presetting initial values of the first and second counters.

In the present invention constructed as described above, when the horizontal and vertical synchronous signals, display signal, and clock signal fed to the display device are different in timing from each other, the preset sections each suitably set the initial value of each of the first and second counters. The number of pulses of the counting signal counted by each of the counters and output to each of the storage sections is corrected to a desired value through setting at the preset section. The storage sections each output a signal stored in its address corresponding to each of the counting signals. The drive section carries out display at a proper position on the display section corresponding to a display signal in response to the signal output.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

Now, a display device according to the present invention will be described hereinafter with reference to FIGS. 1 and 2.

Figure 1:
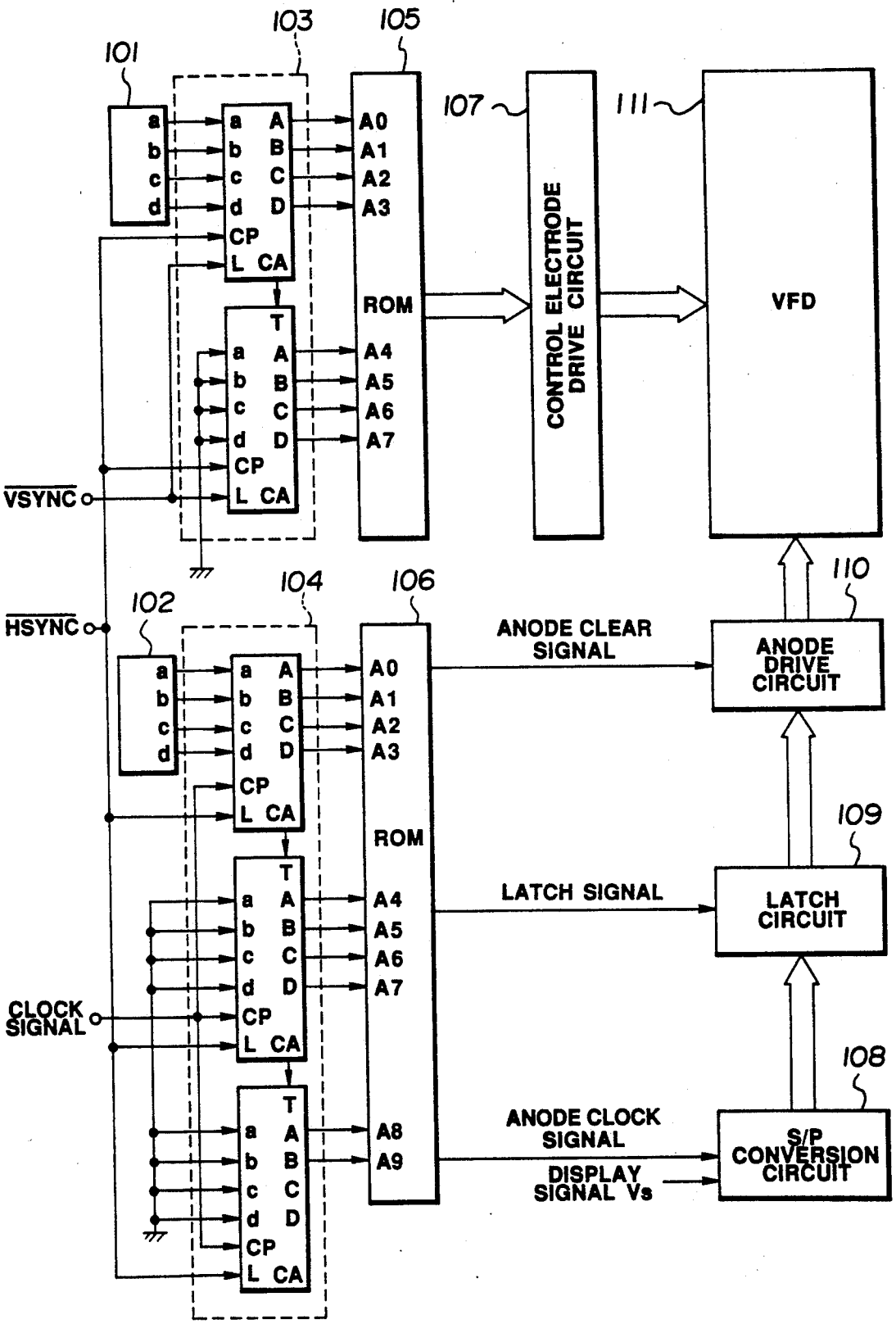
FIG. 1 is a block diagram showing a fluorescent display device which is an embodiment of a display device according to the present invention.
Figure 2:
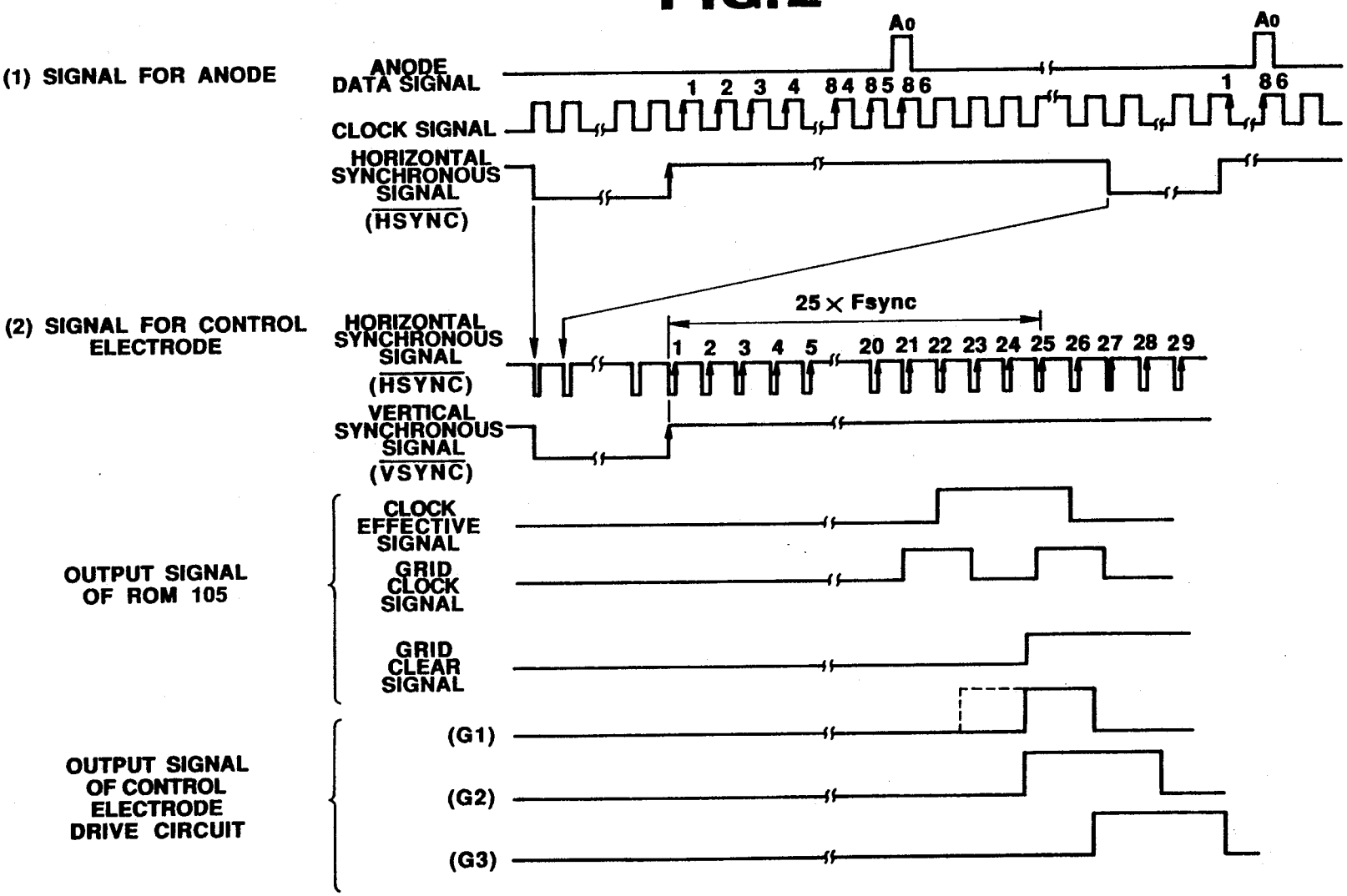
FIG. 2 is a timing chart showing the drive of the fluorescent display device.

FIG. 1 shows an embodiment of a display device according to the present invention which is in the form of a fluorescent display device. A display device of the illustrated embodiment includes digital code switches 101 and 102 each functioning as a preset section, so that rotation of a rotary switch (not shown) causes an four-bit output signal to be varied in sixteen ways of from "0000" to "1111". For each of the digital code switches 101 and 102 may be used a switch commercially available under the tradename "KDS 16-22" from Keru Kabushiki Kaisha.

Figure 3:
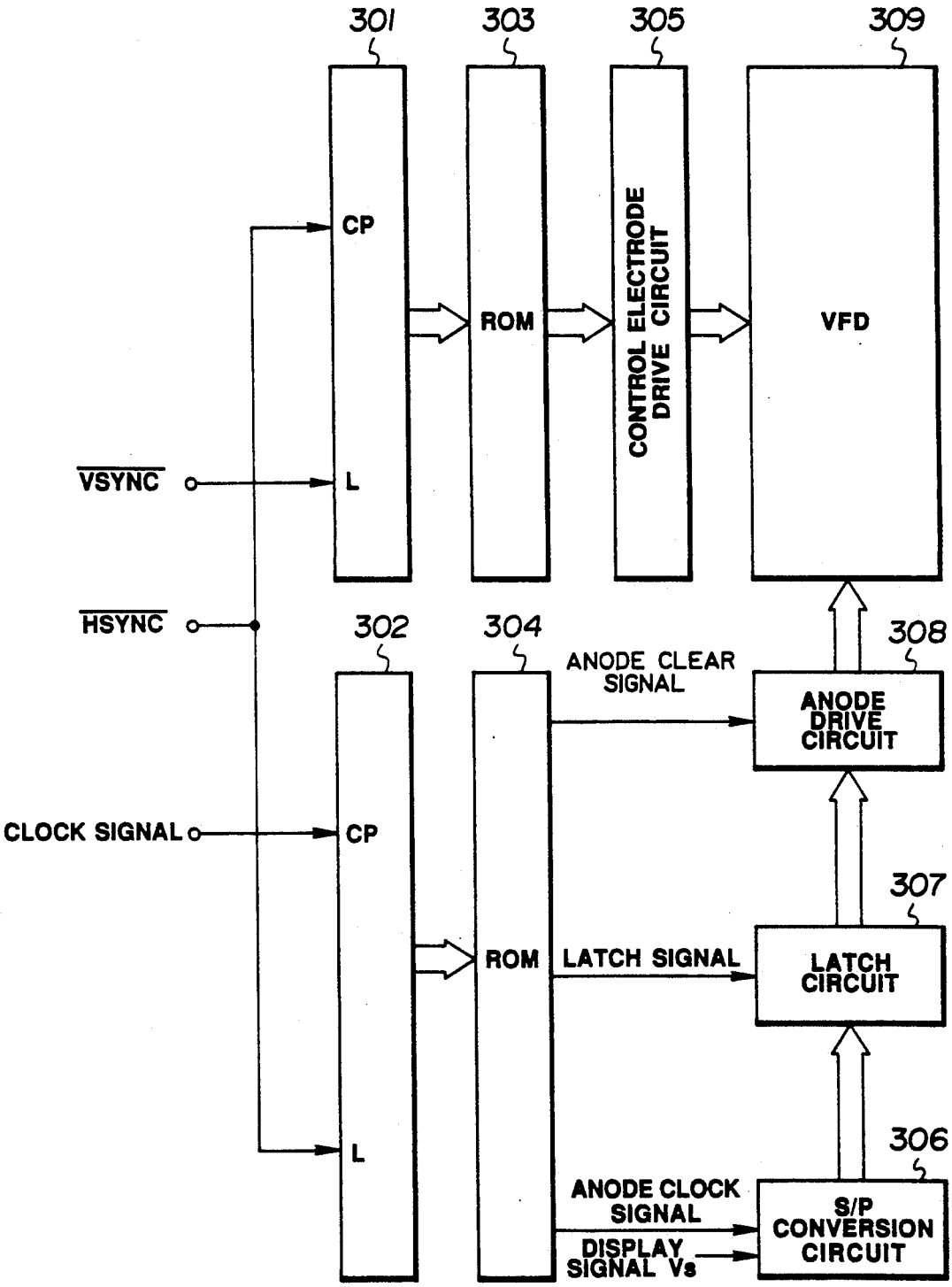
FIG. 3 (PRIOR ART)
FIG. 3 is a block diagram showing a conventional fluorescent display device.

The display device of the illustrated embodiment also includes a first counter 103 and a second counter 104, which may be constructed by arranging binary counters commercially available under the tradename "HD74LS161" from Hitachi Limited in two and three stages, respectively. The first counter 103, as in FIG. 3, is adapted to count an $\overline{\text{HSYNC}}$ in response to the leading of a $\overline{\text{VSYNC}}$ and subsequently outputs a first counting signal corresponding to a value counted by the counter 103. The second counter 104 starts to count a clock signal in response to the leading of the $\overline{\text{HSYNC}}$ to output a second counting signal in turn in response to a value counted thereby. Forefront binary counters of the first and second counters 103 and 104 each include preset terminals a to d connected to the output terminals a to d of the digital code switches 101 and 102, respectively. This results in binary signals of the digital code switches 101 and 102 being initial values of the forefront binary counters of the counters 103 and 104, respectively, so that the counters 103 and 104 start counting from the initial values. All the preset terminals a to d of host binary counters of the counters 103 and 104 are grounded, resulting in their initial values being constantly "0".

Also, the display device of the illustrated embodiment includes a ROM 105 acting as a first storage section and a ROM 106 acting as a second storage section. A circuit structure including a control electrode drive circuit 107, an S/P conversion circuit 108, a latch circuit 109 and an anode drive circuit 110, and a fluorescent display tube (VFD) 111 serving as a display section which are arranged beyond the ROMs 105 and 106 may be constructed in substantially the same manner as in FIG. 3.

Now, the manner of operation of the display device of the illustrated embodiment will be described hereinafter with reference to FIGS. 1 and 2.

(1) Driving of Anodes

A clock signal generated from a personal computer is counted by the second counter 104, which then generates a counting signal. The counting signal is then input to the ROM 106. A preset value of the digital code switch 102 is set to be 7 and if an anode data signal Ao is stored in an address of the ROM 106, it is output from the ROM 106 to the latch circuit 109 when eighty-six pulses of the clock signal are input thereto.

An anode clear signal is input to the anode drive circuit 110 simultaneous with or somewhat later than the latch signal and stored in an address (for example, an address A4) of the ROM 106 corresponding to the sum of the counted value of the clock signal and the preset value, as in the latch signal.

Thus, in synchronism with the anode clock signal from the ROM 106, a display signal Vs is stored in turn in the S/P conversion circuit 108 comprising a shift register and then supplied in the form of a parallel signal to the latch circuit 109. When the latch signal is input to the latch circuit 109, the latch circuit latches the parallel signal to supply it to the anode drive circuit 110; and when the anode clear signal is supplied to the anode drive circuit 110, it supplies an anode drive signal to the VFD 111.

A variation in preset value of the digital code switch 102 permits time at which each of the anode clear signal and latch signal is generated to be varied relative to the clock signal. In the illustrated embodiment, the variation may be carried out in an amount corresponding to fifteen clocks on either side.

(2) Driving of Control electrodes

The first counter 103 counts the HSYNC in synchronism with the leading of the VSYNC to supply the sum of the preset value of the digital code switch 101 and the counted value of the counter 103 to the ROM 105. The ROM 105 supplies data in an address corresponding to the sum to the control electrode drive circuit 107. The output signals of the ROM 105 includes a clock effective signal, a grid clock signal and a grid clear signal. The control electrode drive circuit 107 selects adjacent two of linear control electrodes G1, G2, G3,—of the VFD 111 to drive them in turn while shifting them one by one.

A variation in preset value of the digital code switch 101 permits time at which the drive of the control electrodes is started to be varied. For example, supposing that data are stored so that the grid clear signal is output from the ROM 105 when the number of pulses of the HSYNC counted by the first counter is thirty-two and the preset value of the digital code switch is set to be seven, the grid clear signal is output when twenty-five pulses of the HSYNC are counted, resulting in the driving being started. A variation in preset value of the digital code switch 101 permits time when the driving is started to be varied within a range of fifteen pulses.

Thus, the illustrated embodiment is so constructed that a variation in preset value of each of the digital code switches 101 and 102 permits time when the drive of each of the anodes and control electrodes is started to be varied, resulting in adjusting a display position on an image plane of the VFD 111.

Also, the illustrated embodiment uses the display section comprising the fluorescent display device 111, however, the arrangement of the display section which employs another principle and/or structure in substantially the same manner likewise permits it to exhibit substantially the same function.

As can be seen from the foregoing, the display device of the present invention is so constructed that drive data are stored in the address of the storage section corresponding to the counting signal of each of the counters to set the initial value of the counter at the preset section. Such construction of the present invention, even when the horizontal and vertical synchronous signals, clock signal and display signal are different in timing, permits the preset value of each counter to be varied to adjust deviation of the display section, resulting in exhibiting adequate display.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A deviation adjustable display device comprising:

a first counter for counting a horizontal synchronous signal in response to a vertical synchronous signal to obtain a first counting signal when the counted value reaches a first predetermined initial value;

a first storage section for outputting a signal stored in an address corresponding to said first counting signal;

a second counter for counting a clock signal in response to the horizontal synchronous signal to output a second counting signal when the counter value reaches a second predetermined initial value;

a second storage section for outputting a signal stored in an address corresponding to said second counting signal;

a display section;

a drive section for driving said display section whereby said display section provides a display corresponding to a display signal in response to signals from said first and second storage section; and preset sections for presetting the initial values of said first and second counters, respectively, whereby a desirable deviation of the display is carried out an image plane of said display section by adjusting each of the initial values of said first and second counters to change the timing of said driving of said display section when the display is not centrally positioned on said display section because of the different timing of the clock signal, the horizontal synchronous signal and the vertical synchronous signal.

2. A display device as defined in claim 1, wherein said first counter is constructed by arranging binary counters in two stages.

3. A display device as defined in claim 1, wherein said second counter is constructed by arranging binary counters in three stages.

4. A display device as defined in claim 1, wherein said preset sections comprise digital code switches.

* * * * *